US005458529A

United States Patent [19]

Hasegawa et al.

[11] Patent Number: 5,458,529

[45] Date of Patent: Oct. 17, 1995

[54] APPARATUS FOR POLISHING NOTCH PORTION OF WAFER

[75] Inventors: Fumihiko Hasegawa; Tatsuo Ohtani, both of Fukushima; Koichiro Ichikawa; Yoshio Nakamura, both of Nagano, all of Japan

[73] Assignees: Shin-etsu Handotal Co., Ltd., Tokyo; Fujikoshi Machinery Corp., Nagano, both of Japan

[21] Appl. No.: 249,933

[22] Filed: May 26, 1994

[30] Foreign Application Priority Data

Jun. 11, 1993 [JP] Japan ..... 5-166172

[51] Int. Cl.[6] ..... B24B 7/00

[52] U.S. Cl. ..... 451/177; 451/44

[58] Field of Search ..... 451/44, 144, 146, 451/129, 139

[56] References Cited

U.S. PATENT DOCUMENTS

| | | | |
|---|---|---|---|
| 1,220,287 | 3/1917 | Styll et al. | 451/231 |
| 4,905,425 | 3/1990 | Sekigawa et al. | 451/41 |
| 5,185,965 | 2/1993 | Ozaki . | |
| 5,271,185 | 12/1993 | Hosokawa | 451/44 |
| 5,289,661 | 3/1994 | Jones et al. . | |

FOREIGN PATENT DOCUMENTS

| | | |
|---|---|---|
| 0404460 | 12/1990 | European Pat. Off. . |
| 0518642 | 12/1992 | European Pat. Off. . |

*Primary Examiner*—Bruce M. Kisliuk
*Assistant Examiner*—Derris Banks
*Attorney, Agent, or Firm*—Oliff & Berridge

[57] ABSTRACT

A polishing apparatus which can effectively polish a bottom wall of a wafer in the notch portion is disclosed. The polishing apparatus includes: a table for supporting the wafer thereon; a rotary buff having a thickness so that the periphery thereof can enter the notch portion of the wafer, and is rotated around an axis which is parallel with a plane of the surface of the wafer supported on the table; a first rotating member such as a motor for rotating the rotary buff; a movable linkage for supporting the rotary buff; an adjusting member such as a cylinder device for adjusting the pressure applied to the bottom wall of the wafer in the notch portion from the rotary buff; and a second rotating member such as a pulse motor for turning the rotary buff around a predetermined axis so that the applied pressure from the rotary buff acts on the bottom wall of the wafer in the notch portion in a direction approximately perpendicular to the surface of the bottom wall.

16 Claims, 6 Drawing Sheets

APPARATUS FOR POLISHING NOTCH PORTION OF WAFER

BACKGROUND OF THE INVENTION

1. Field of the Invention

The present invention relates to a polishing apparatus for a notch portion of a wafer which is used for positioning adjustment or crystal orientation adjustment of the wafer.

2. Description of Related Art

Generally, a photolithographic technique is used for the purpose of forming a pattern for a semiconductor integrated circuit in a semiconductor wafer, e.g., a Si single crystal wafer, a compound semiconductor wafer or the like (hereinafter, which is simply called "a wafer"). Such an application of the photolithographic technique requires a precise positioning adjustment and a precise crystal orientation adjustment. For these requirements, a linear portion is generally made on one side of the periphery of the wafer in order to use the linear portion as a standard for the positioning adjustment and the crystal orientation adjustment. The linear portion of the wafer is called an orientation flat.

When such an orientation flat is formed on the wafer, a portion of the periphery of the wafer is cut off linearly. Therefore, the area of the cut portion of the wafer is large, so the number of semiconductor chips which can be fabricated from a wafer decrease. As a result, according to such a conventional method in which an orientation flat is formed on a wafer, it is impossible to effectively utilize an expensive wafer. The conventional method has another problem in that it is difficult to treat wafers when each of the wafers has a large diameter and an orientation flat, so the wafers are not properly in balance, for example, on a work using a spin dryer or the like in which the wafers are dried by a centrifugal force due to a high speed rotation.

Recently, in order to solve the above problems, another method has been used in which a small notch having a circular arc shape or a shape of a character "V" in plan view is formed in a portion of the periphery of each wafer. In this method, positioning and crystal orientation adjustments of the wafer are carried out by using the notch.

Such a notch is formed by using a grinding wheel 31 or the like, as shown in FIG. 5. That is, the notch portion 32 is formed by making the grinding wheel 31 press into a portion of the periphery of the wafer W and by grinding the portion, as shown in the plan view of FIG. 6. FIG. 7 is a vertically cross-sectional view showing the wafer W cut along the line 7—7 of FIG. 6. The wall of the wafer W in the notch portion 32 swells into a curve toward the outside in the middle of vertical direction, as shown in this Figure.

In a photolithographic process, particles may be a main impact to form fine patterning for semiconductor devices. Therefore, in order to minimize the amount of the particles, a clean room having a higher cleanliness is required. Furthermore, it is desired to suppress generation of particles from the wafer as less as possible.

In order to solve the above problems, it is necessary to polish the wall of the wafer in the notch portion 32 and thereby to prevent generation of particles when the wall of the wafer in the notch portion 32 is in contact with a hard pin for crystal orientation adjustments of the wafer. However, the width of the notch portion 32 to be formed is smaller than that of the orientation flat. The notch portion 32 has a circular arc shape or a shape of a character "V" in plan view and the wall of the wafer W has a complicated shape in the notch portion 32. Therefore, it is difficult to polish the wall of the wafer W in the notch portion 32.

SUMMARY OF THE INVENTION

The present invention was developed in view of the above-described problems. An object of the present invention is to provide an apparatus which can effectively polish the wall of the wafer in the notch portion.

The polishing apparatus for a notch portion of a wafer comprising: a table for supporting the wafer thereon; a rotary buff having a thickness so that the periphery thereof can be enter the notch portion of the wafer, and is rotated around an axis which is parallel with a plane of the surface of the wafer supported on the table; a first rotating member for rotating the rotary buff; a movable linkage for supporting the rotary buff; an adjusting member for adjusting the pressure applied to the bottom wall of the wafer in the notch portion from the rotary buff; and a second rotating member for turning the rotary buff around a predetermined axis so that the applied pressure from the rotary buff acts on the bottom wall of the wafer in the notch portion in a direction approximately perpendicular to the surface of the bottom wall.

In the polishing apparatus for a notch portion of a wafer of the present invention, the rotary buff is pressed against the bottom wall of the notch portion of the wafer supported on the table by the adjusting member such as a cylinder device, and the rotary buff is rotated on the center axis thereof by the first rotating member. Further, the rotary buff is turned around a predetermined axis by the second rotating member so that the applied pressure from the rotary buff acts on the bottom wall of the wafer in the notch portion in a direction approximately perpendicular to the surface of the bottom wall. Consequently, since the rotating buff presses the bottom wall of the wafer in the notch portion, while following on the surface of the wall, the bottom wall of the wafer in the notch portion can be polished. The pressure applied to the bottom wall of the wafer in the notch portion can be always maintained constantly in spite of the attitude or angle of the linkage by the adjusting member. Accordingly, it is possible to obtain a bottom wall in the notch portion having an excellent polishing surface. The linkage may bring the rotary buff in contact with and apart from the wafer, and the linkage preferably comprises a first link which is connected with the second rotating member and a second link for supporting the rotary buff.

Preferably, the table can reciprocally rotate the wafer supported on the table around the center thereof in clockwise and counterclockwise directions within a predetermined small angle, by a pulse motor or the like.

Accordingly, a pair of side walls of the wafer in the notch portion can also be polished by the rotary buff which reciprocally rotates in clockwise and counterclockwise directions within a predetermined small angle. As a result, the whole wall of the wafer in the notch portion can be excellently polished.

Preferably, the table may be communicated with a vacuum absorption system, so that the wafer can be held on the table by vacuum absorption. The second electric motor may be a pulse motor.

Preferably, the first link may have an end portion which is forked into two branches, and one of the two branches is connected with the second electric motor. The other of the two branches may be supported by a bearing. The bearing and the second electric motor may be preferably disposed so that the central axis of the bearing and the shaft of the second electric motor are on a straight line which is parallel with the plane of the surface of the wafer supported on the table. The wafer may be set on the table so that the straight line is substantially in contact with the notch portion of the wafer.

Preferably, at least a bracket may be erected on the first link and the second link is provided so that the second link is movable like a seesaw on a shaft which is attached to an upper portion of the bracket. The rotary buff and the first electric motor may be attached to one end of the second link, and the cylinder device is disposed between an end of the first link opposite to the branches and the other end of the second link. The apparatus may preferably have a construction so that the table can be relatively moved with respect to a predetermined axis around which the rotary buff may be turned. An alkaline solution with dispersed colloidal silica or the like may be supplied as a polishing agent into the notch portion of the wafer, during polishing. The cylinder device may be one selected from the group consisting of an air cylinder device and a hydraulic cylinder device. The air-pressure in the cylinder device may be preferably kept constant so that the pressure applied to the bottom wall of the wafer in the notch portion is substantially maintained constant in spite of the attitude or angle of the linkage.

Other features and advantages of the present invention will be apparent from the following description taken in connection with the accompanying drawing. While the preferred embodiments of the present invention is described, it should also be understood that modifications will be apparent to those skilled in the art without departing from the spirit of the present invention.

BRIEF DESCRIPTION OF THE INVENTION

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinafter, a preferred embodiment of the polishing apparatus for a notch portion of a wafer according to the present invention will be explained with reference to the drawings.

Figure 1:
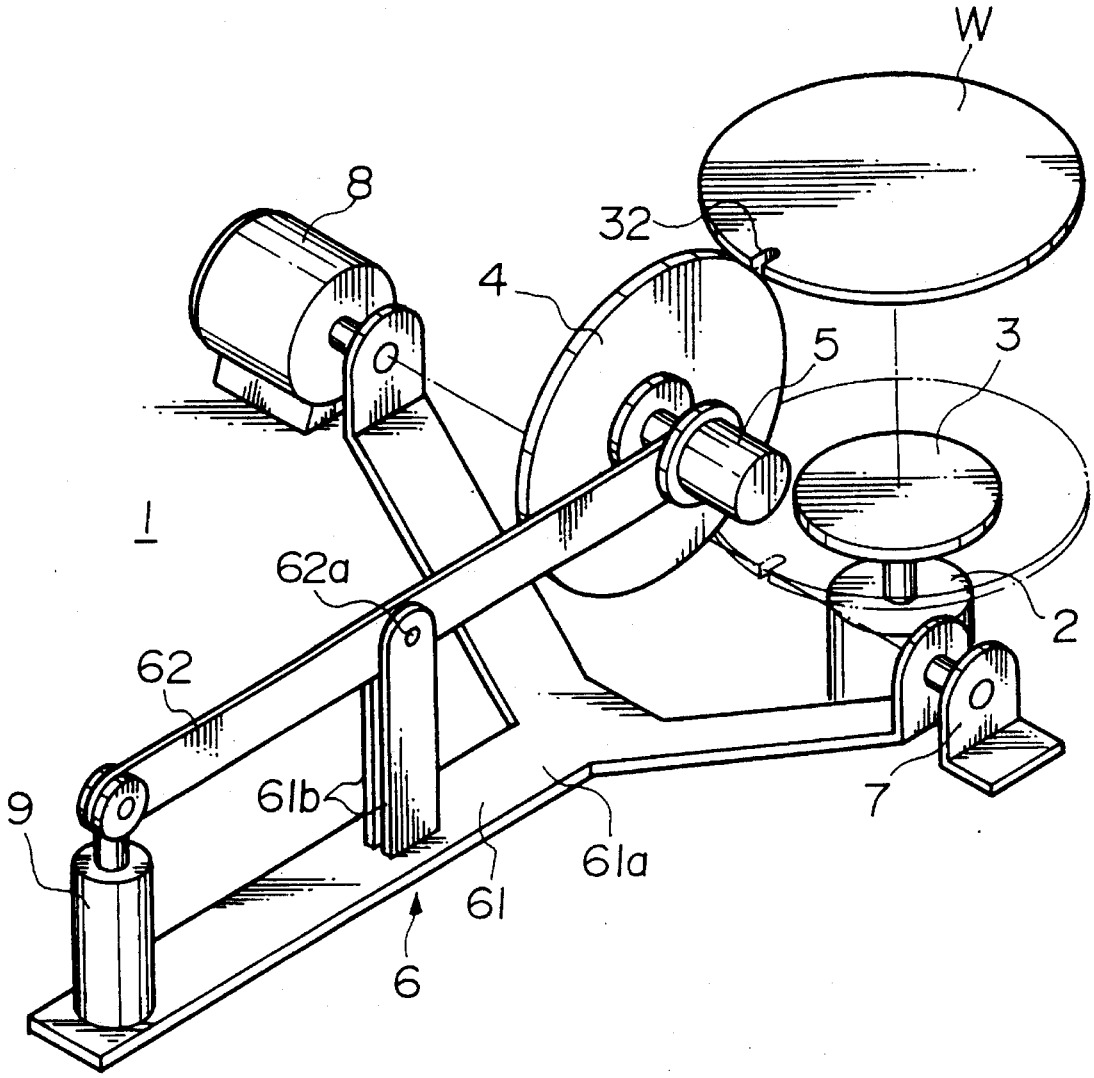
FIG. 1 is a perspective view showing a polishing apparatus for a notch portion of a wafer according to an embodiment of the present invention.

FIG. 1 shows a polishing apparatus for a notch portion of a wafer. In this Figure, numeral 1 denotes the polishing apparatus for a notch portion of a wafer. The polishing apparatus 1 for a notch portion comprises a table 3 for holding a wafer W thereon, and a pulse motor 2 which can repeatedly make the table 3 reciprocally rotate around the center thereof in clockwise and counterclockwise directions within a predetermined small angle. A vacuum absorption system, which is not shown in the attached drawings, is communicated with the table 3, so that the wafer W can be held on the table 3 by vacuum absorption.

The polishing apparatus 1 for a notch portion comprises a rotary buff 4 which is made of an elastic material, e.g., a synthetic resin such as expanded polyurethane or the like. The rotary buff 4 is connected with an electric motor (a first motor) 5 which makes the rotary buff 4 rotate, through a shaft, and is supported by a linkage 6. The rotary buff 4 can rotate around the shaft which is parallel with the plane of the surface of the wafer W held on the table 3.

The linkage 6 comprises a first link 61 having a plate 61*a* and a pair of brackets 61*b*, and a second link 62. The plate 61*a* of the link 61 comprises a side of a front end which is forked into two branches. One of the two branches is supported by a bearing 7, and the other of the branches is connected with a pulse motor (a second motor) 8. The bearing 7 and the pulse motor 8 are disposed so that the central axis of the bearing 7 and the shaft of the pulse motor 8 are on a straight line and the straight line is parallel with the plane of the surface of the wafer W and is substantially in contact with the notch portion 32 of the wafer W. A pair of brackets 61*b* and 61*b* are erected at the middle on the plate 61*a* of the first link 61. The second link 62 is provided so that the link 62 is movable like a seesaw on a shaft 62*a* which is attached to an upper portion of the pair of brackets 61*b* and 61*b*. The rotary buff 4 and the electric motor 5 are attached on one end of the second link 62. An air cylinder device 9 is disposed between the other end of the second link 62 and the rear end of the first link 61. That is, the bottom of the air cylinder device 9 is fixed on the rear end of the first link 61, and the top end of a rod of the air cylinder device 9 is provided so as to form a turning pair with the second link 62. The second link 62 can be operated independent of the first link 61 by means of the air cylinder device 9. The air cylinder device 9 is communicated with an air supply and exhaust apparatus and an air pressure control unit, which are not shown in the drawings.

Next, a procedure for polishing the notch portion 32 of the wafer W carried out by the polishing apparatus 1 of a notch portion will be explained.

Figure 2:
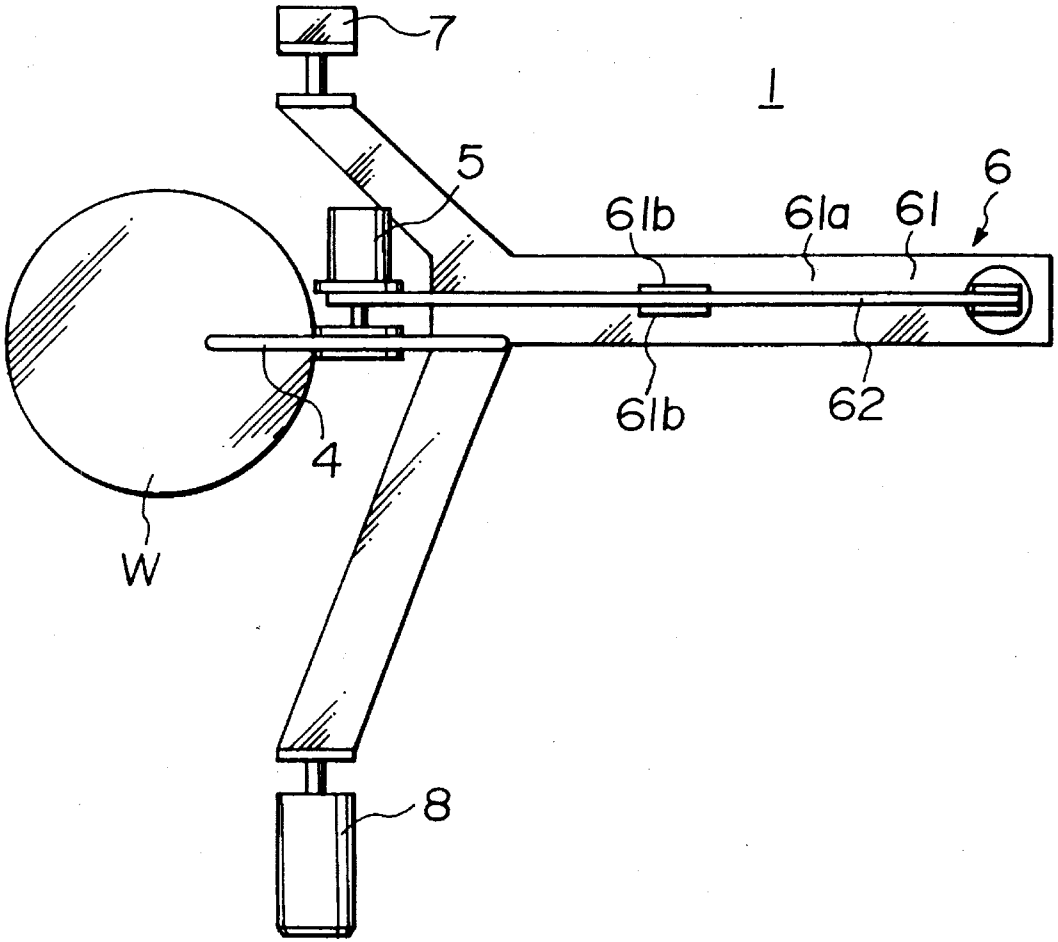
FIG. 2 is a plan view showing the polishing apparatus for the notch portion of the wafer as shown in FIG. 1.

First, a wafer W is set on the table 3 by vacuum absorption or the like. When the wafer W is set on the table 3, the linkage 6 is set up so that the notch portion 32 of the wafer W is positioned on the straight line which connects the central axis of the bearing 7 and the shaft of the pulse motor 8, as shown in FIG. 2. For properly setting up the linkage 6, it is desired to previously and properly set up the relationship between the position of the table 3 and the positions of the bearing 7 and the pulse motor 8; or to construct the linkage 6 so that the bearing 7 and the pulse motor 8 can be relatively moved with respect to the table 3. When the wafer W is set on the table 3, the rotary buff 4 is apart from the wafer W by means of the air cylinder device 9.

Figure 3:
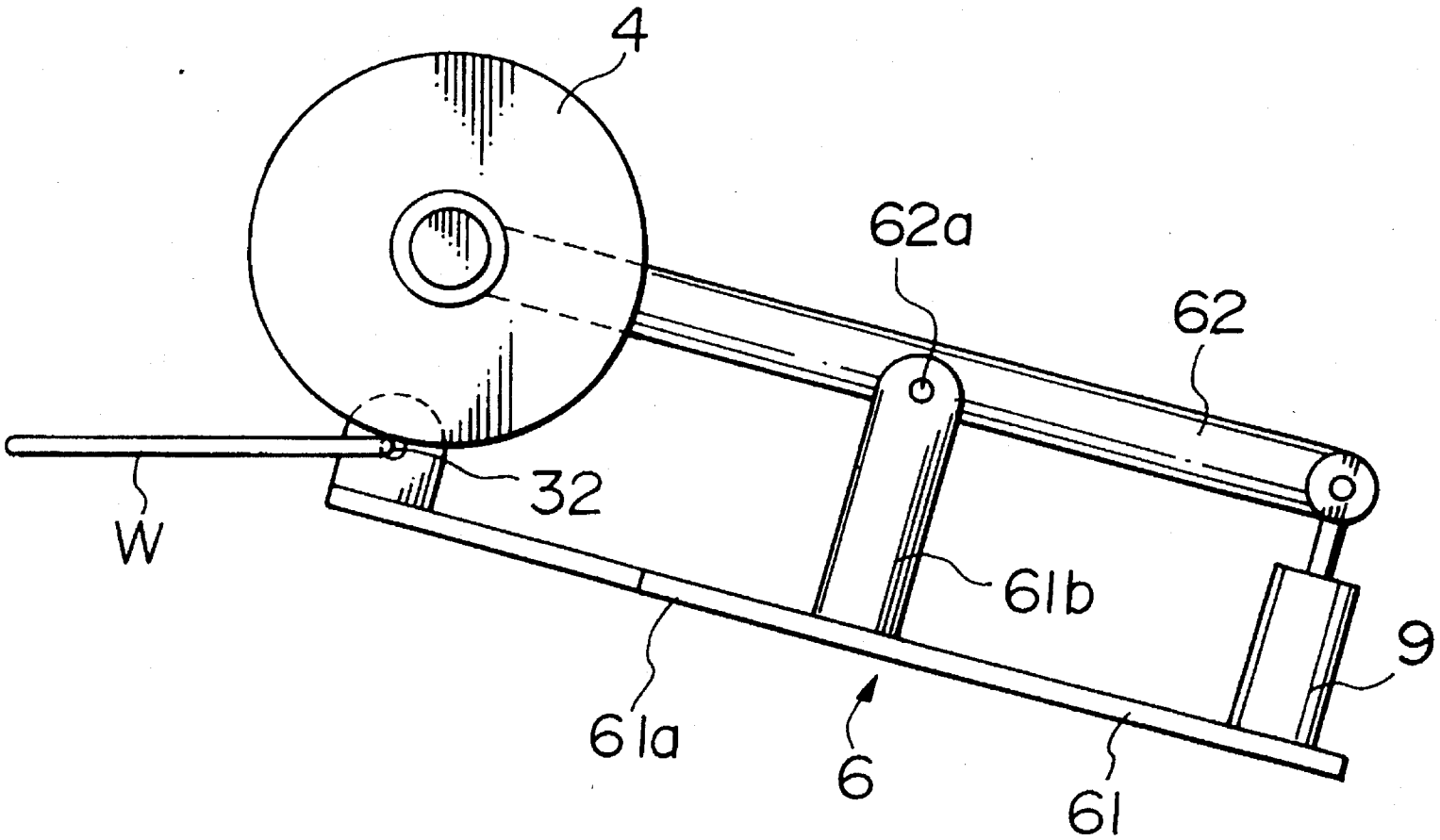
FIG. 3 is a side view showing the polishing apparatus for the notch portion of the wafer as shown in FIG. 1.
Figure 4:
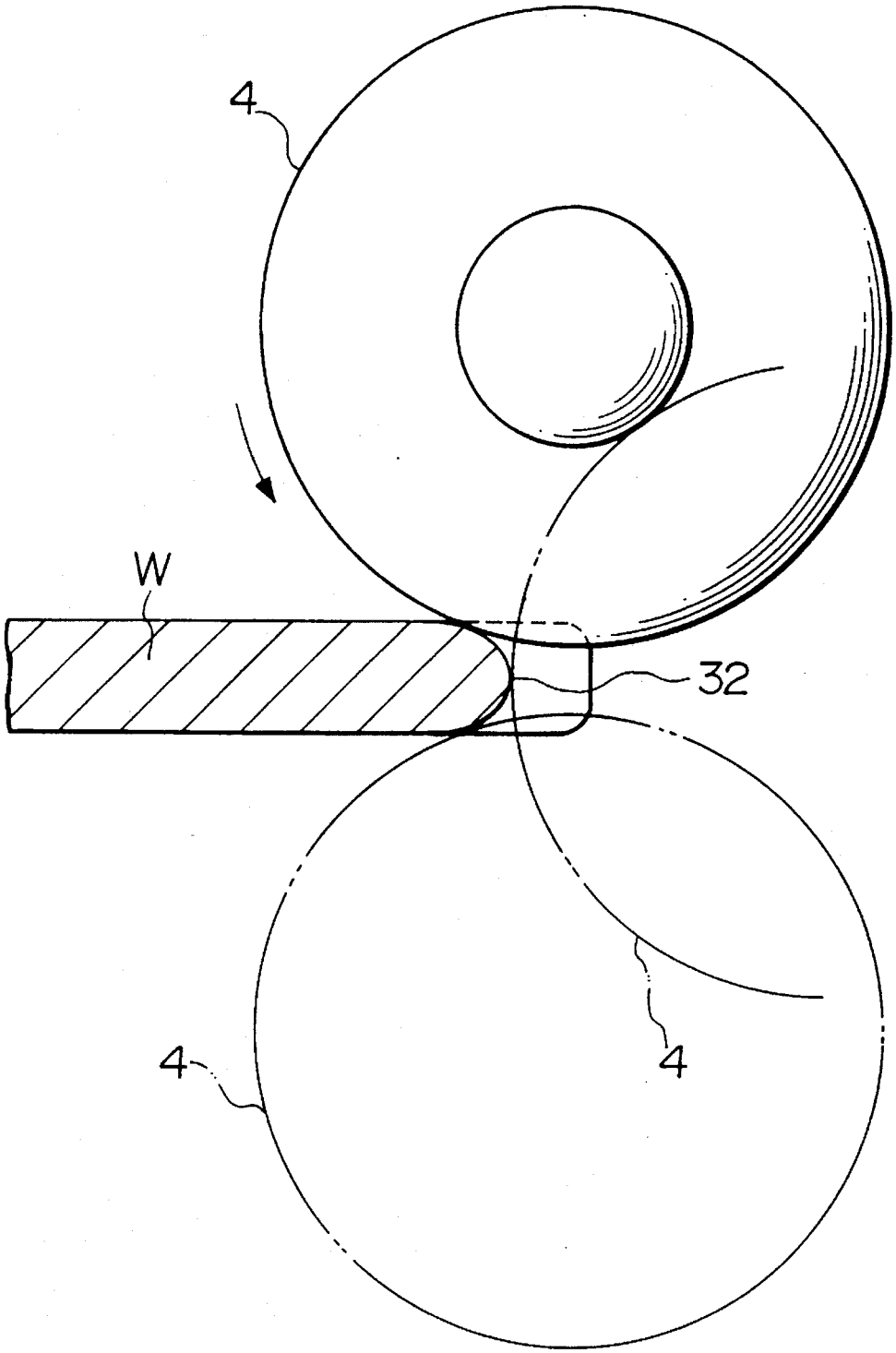
FIG. 4 is a vertically cross-sectional view for explaining an operation of the polishing apparatus for the notch portion of the wafer as shown in FIG. 1.
Figure 5:
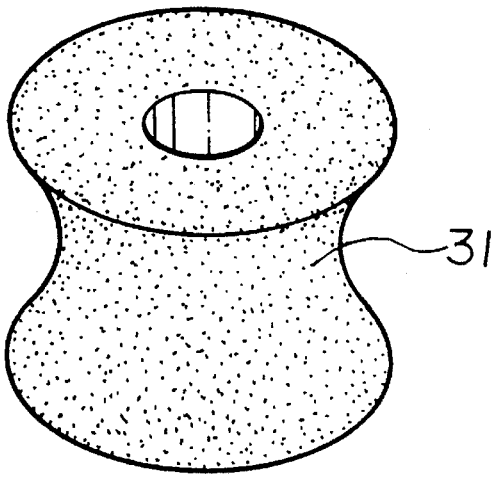
FIG. 5 is a perspective view showing a grinding wheel for forming the notch portion of the wafer.
Figure 6:
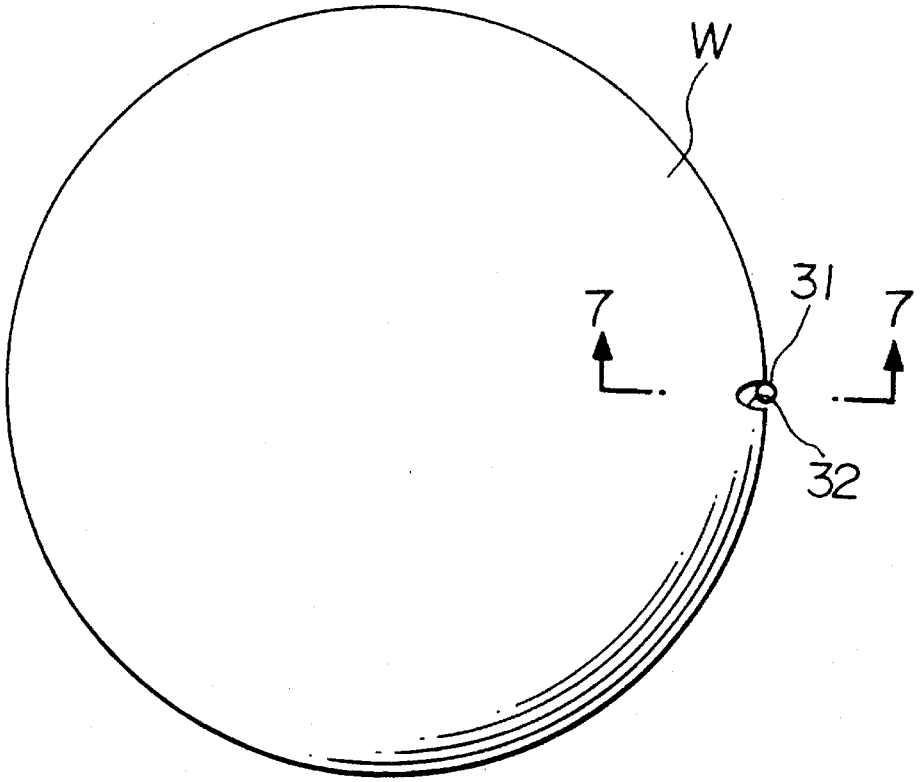
FIG. 6 is a plan view showing a wafer having a notch portion.
Figure 7:
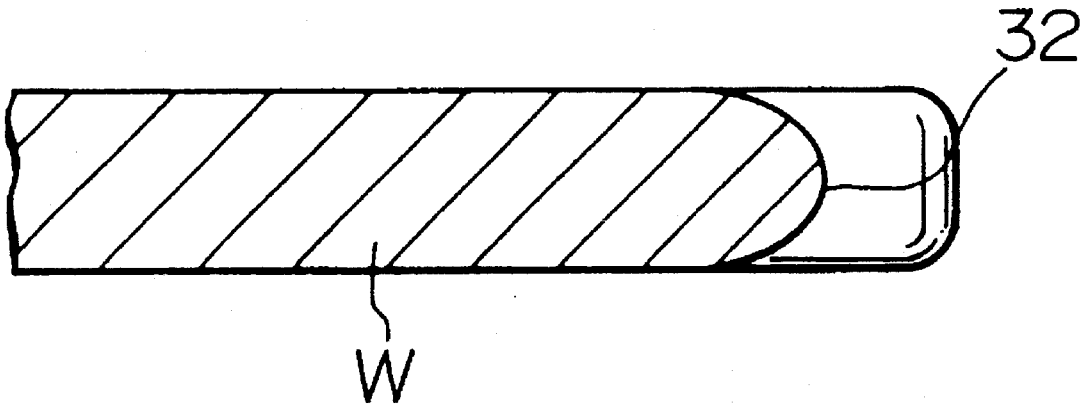
FIG. 7 is a vertically cross-sectional view taken along the line 7—7 in FIG. 6.

Next, the air cylinder device 9 is operated to press the rotary buff 4 against the bottom wall of the wafer W in the notch portion 32. Then, the pressing portion of the peripheral surface of the rotary buff 4 is elastically deformed to a small extent, and thereby the rotary buff 4 comes in contact with the wafer W in a larger area, as shown in FIG. 3. Thereafter, the rotary buff 4 is slowly turned around the straight line which connects the central axis of the bearing 7 and the shaft of the pulse motor 8, by the pulse motor 8 so that the applied pressure from the rotary buff 4 acts on the bottom swelling wall of the wafer W in the notch portion in a direction perpendicular to the surface of the bottom wall, while the rotary buff 4 is rotated by the electric motor 5, as shown in FIG. 4. During this operation, a polishing agent, e.g., an alkaline solution with dispersed colloidal silica or the like, is supplied into the notch portion 32 of the wafer W. The turning operation of the rotary buff 4 around the above mentioned straight line is carried out in a manner of reciprocating motion a predetermined number of times along the curved surface of bottom wall of the wafer W in the notch portion 32.

The table 3 can be reciprocally rotated around the center thereof in clockwise and counterclockwise directions within a predetermined small angle by the pulse motor 2, if necessary. Accordingly, a pair of side walls of the wafer W in the notch portion 32, which extend in an approximately radial direction, can also be polished by the rotary buff which reciprocally rotates in clockwise and counterclockwise directions within a predetermined small angle. As a result, the whole walls of the wafer in the notch portion, that is, the bottom wall and the pair of side walls in the notch portion, can be excellently polished.

The above-described polishing apparatus 1 for a notch portion provides effects as follows.

According to the polishing apparatus of this embodiment, since the rotary buff 4 moves in a manner of following the swelling curved surface of the bottom wall in the notch portion 32, it is possible to effectively polish the bottom wall of the wafer in the notch portion. The linkage 6 is turned around the straight line which connects the central axis of the bearing 7 and the shaft of the pulse motor 8. Therefore, the rotary buff 4 can be turned around the shaft of the pulse motor 8 so that the applied pressure from the rotary buff acts on the bottom curved wall of the wafer W in the notch portion 32 in a direction perpendicular to the curved surface of the bottom wall. The pressure applied to the bottom wall of the wafer W in the notch portion 32 can be constantly maintained by keeping the air-pressure in the cylinder device 9 constant. Accordingly, it is possible to obtain an excellent polishing surface over the whole bottom curved wall of the wafer W in the notch portion 32.

The table 3 can make the notch portion 32 of the wafer W reciprocally rotate on a plane perpendicular to the pressing direction of the rotary buff 4 around the center thereof in clockwise and counterclockwise directions within a predetermined small angle. As the result, the side walls of the wafer W in the notch portion 32 are also polished by both surfaces of the rotary buff 4, so that the notch portion having excellent polished inner walls can be effectively obtained.

Although the present invention has been described in its preferred form with a certain degree of particularlity, it should also be understood that the present invention is not limited to the preferred embodiment and that various changes and modifications may be made to the invention without departing from the spirit and scope thereof.

For example, the air cylinder device 9 is used in the above embodiment, however, a hydraulic cylinder device can be also used instead of the air cylinder device 9.

As described above, according to the present invention, since the rotary buff moves in a manner of following the swelling curved surface of the bottom wall of the wafer in the notch portion, it is possible to effectively polish the bottom wall of the wafer in the notch portion. The rotary buff 4 can be turned around the shaft of the pulse motor so that the applied pressure from the rotary buff acts on the bottom wall of the wafer in the notch portion in a direction perpendicular to the surface of the wall. The pressure applied to the bottom wall of the wafer in the notch portion can be always maintained constantly by keeping the air-pressure in the cylinder device constant. Accordingly, it is possible to obtain an excellent polishing surface over the whole bottom wall of the wafer in the notch.

The table can make the wafer reciprocally rotate around the center thereof in a clockwise and a counterclockwise directions within a predetermined small angle. Accordingly, the whole wall of the wafer in the notch portion can also be excellently polished.

What is claimed is:

1. A polishing apparatus for a notch portion which is formed on a periphery of a wafer and said notch portion has a bottom wall with a curved surface, comprising:

a table for supporting the wafer thereon;

a rotary buff having a thickness so that a periphery thereof can enter the notch portion of the wafer, and is rotated around an axis which is parallel with a plane of a surface of the wafer supported on said table;

a first rotating member for rotating said rotary buff;

a movable linkage for supporting said rotary buff;

an adjusting member for adjusting the pressure applied to the bottom wall of the wafer in the notch portion from said rotary buff; and a second rotating member for turning the movable linkage which supports said rotary buff around a predetermined axis so that the periphery of the rotary buff follows the curved surface of the bottom wall of the wafer in the notch portion and said applied pressure from the rotary buff acts on said bottom wall in a direction approximately perpendicular to the surface of said bottom wall.

2. A polishing apparatus as claimed in claim 1, wherein said linkage can bring the rotary buff in contact with and apart from the wafer, said linkage comprising a first link which is connected with said second rotating member and a second link for supporting said rotary buff.

3. A polishing apparatus as claimed in claim 1, wherein said table can be reciprocally rotated around the center thereof in clockwise and counterclockwise directions within a predetermined small angle so that side walls of the wafer in the notch portion can be polished by the rotary buff.

4. A polishing apparatus as claimed in claim 1, wherein said second rotating member is a motor.

5. A polishing apparatus as claimed in claim 2, wherein said first link has an end portion which is forked into two branches, and one of the two branches is connected with said second rotating member and the other is supported by a bearing.

6. A polishing apparatus as claimed in claim 5, wherein said second rotating member and said bearing are disposed so that the shaft of the second rotating member and the central axis of the bearing are on a straight line which is parallel with the plane of the surface of the wafer supported on said table.

7. A polishing apparatus as claimed in claim 6, wherein the wafer is set on the table so that said straight line passes through the notch portion of the wafer.

8. A polishing apparatus as claimed in claim 2, wherein at least a bracket is erected on said first link and said second link is provided so that the second link is movable like a seesaw on a shaft which is attached to an upper portion of said bracket.

9. A polishing apparatus as claimed in claim 8, wherein said rotary buff and said first rotating member are attached to one end of said second link, and a cylinder device is disposed between an end of said first link opposite to the portion connected with the second rotating member and the other end of said second link to move the second link supporting the rotary buff on the shaft attached to the upper portion of the bracket.

10. A polishing apparatus for a notch portion of a wafer as claimed in claim 21, wherein said adjusting member comprises a cylinder device for moving said second link supporting the rotary buff independently of said first link.

11. A polishing apparatus as claimed in claim 10, wherein said cylinder device is one selected from the group consisting of an air cylinder device and a hydraulic cylinder device.

12. A polishing apparatus as claimed in claim 1, wherein said table is relatively movable with respect to said predetermined axis around which said rotary buff is turned.

13. A polishing apparatus as claimed in claim 1, wherein an alkaline solution with dispersed colloidal silica is supplied as a polishing agent into the notch portion of the wafer, during polishing.

14. A polishing apparatus as claimed in claim 10, wherein an air-pressure in said cylinder device is kept constant so that a pressure applied to the bottom wall of the wafer in the notch portion is substantially maintained constantly in spite of an attitude or angle of the linkage.

15. A polishing apparatus for a notch of a wafer which is formed by making a notch on a portion of the periphery of the wafer comprising:

a table for supporting a wafer thereon;

a rotary buff having a periphery with a section of almost the same shape as the shape of the notch portion in plan view, and is rotated around a rotary buff axis which is parallel with a plane of the surface of the wafer supported on said table;

a first electric motor for rotating said rotary buff;

a linkage movable in contact with and apart from the wafer supported on said table, said linkage comprising a first link and a second link for supporting said rotary buff;

a cylinder for moving said second link for supporting the rotary buff independently of said first link; and a second electric motor for turning the rotary buff around a predetermined axis spaced from said rotary buff axis so that an applied pressure from said rotary buff acts on the wall of the wafer in the notch portion in a direction approximately perpendicular to the surface of the wall of the wafer in the notch portion.

16. A polishing apparatus as claimed in claim 15, wherein said table can be reciprocally rotated around the center thereof in clockwise and counterclockwise directions within a predetermined small angle so that side walls of the wafer in the notch portion can be polished by the rotary buff.

* * * * *

UNITED STATES PATENT AND TRADEMARK OFFICE

CERTIFICATE OF CORRECTION

PATENT NO. : 5,458,529

DATED : October 17, 1995

INVENTOR(S) : Fumihiko HASEGAWA, Tatsuo OHTANI, Koichiro ICHIKAWA and Yoshio NAKAMURA It is certified that error appears in the above-indentified patent and that said Letters Patent is hereby corrected as shown below: On the title page: Item

[73] Change "Handotal" to --Handotai--.

Signed and Sealed this

Nineteenth Day of December, 1995

*Attest:*

*Attesting Officer*

BRUCE LEHMAN

*Commissioner of Patents and Trademarks*